US009975237B2

(12) United States Patent
Norris

(10) Patent No.: US 9,975,237 B2
(45) Date of Patent: May 22, 2018

(54) PLATFORM WITH REMOVABLE PEGS FOR ORGANIZING SOCKETS

(71) Applicant: Andrew Norris, Proctorville, OH (US)

(72) Inventor: Andrew Norris, Proctorville, OH (US)

( * ) Notice: Subject to any disclaimer, the term of this patent is extended or adjusted under 35 U.S.C. 154(b) by 0 days. days.

(21) Appl. No.: 15/619,255

(22) Filed: Jun. 9, 2017

(65) Prior Publication Data

US 2017/0355073 A1 Dec. 14, 2017

Related U.S. Application Data

(60) Provisional application No. 62/347,743, filed on Jun. 9, 2016.

(51) Int. Cl.
*B25H 3/00* (2006.01)
*B25H 3/06* (2006.01)
*B25H 3/04* (2006.01)

(52) U.S. Cl.
CPC ..... *B25H 3/003* (2013.01); *B25H 3/06* (2013.01); *B25H 3/04* (2013.01)

(58) Field of Classification Search
CPC ..... B25H 3/003; B25H 3/06; B25H 3/04
USPC ..... 211/70.6; 206/378, 376, 477
See application file for complete search history.

(56) References Cited

U.S. PATENT DOCUMENTS 2,614,841 A * 10/1952 Bernard ..... A63F 9/0093 235/90
2,655,381 A * 10/1953 Forling ..... A63F 3/00088 273/236
D175,455 S * 8/1955 Bartleman ..... 211/70.6
2,852,863 A * 9/1958 Homan ..... A63F 3/0423 235/90
3,154,281 A * 10/1964 Frank ..... F16B 21/06 174/138 G
3,405,377 A * 10/1968 Pierce ..... B25B 13/56 206/378
3,561,774 A * 2/1971 Brinser ..... A63F 3/00094 273/241
4,154,795 A * 5/1979 Thorne ..... B01L 3/5085 206/460
4,239,230 A * 12/1980 Shoptaugh ..... A63F 3/00574 273/264
4,337,860 A * 7/1982 Carrigan ..... B25H 3/003 206/376
4,397,395 A * 8/1983 McKelvey ..... B25H 3/003 206/369
4,522,408 A * 6/1985 McKee ..... A63F 3/00094 273/271

(Continued)

*Primary Examiner* — Joshua J Michener
*Assistant Examiner* — Devin K Barnett

(57) ABSTRACT

A platform with removable pegs for organizing sockets uses a base panel, multiple peg receptacles, multiple socket-receiving pegs, and a ratchet holder to form a socket tray that can be reconfigured by a user. The base panel is a platform that supports the socket-receiving pegs and the ratchet holder. The peg receptacles traverse into the base panel and are used to form mounting holes into which the socket-receiving pegs are inserted. The socket-receiving pegs are rods that support the socket heads of a socket wrench set. The user is able to create unique storage arrangements by inserting the socket-receiving pegs into the peg receptacles which are distributed across the base panel. The ratchet holder is a mounting system that enables the user to store the ratchet of the socket wrench on the socket tray.

5 Claims, 6 Drawing Sheets

(56) References Cited

U.S. PATENT DOCUMENTS 4,688,672 A * 8/1987 Pemberton ..... B25H 3/003 206/378
D291,841 S * 9/1987 Owens ..... D3/26
4,798,292 A * 1/1989 Hauze ..... A61L 2/26 206/210
4,927,020 A * 5/1990 Randy ..... B25B 13/56 206/378
4,927,158 A * 5/1990 Lierman ..... A63F 9/04 273/146
5,069,458 A * 12/1991 Washington ..... A63F 3/00643 273/238
5,133,455 A * 7/1992 Chow ..... B25H 3/06 206/373
5,154,544 A * 10/1992 Arendt ..... B25H 3/06 206/375
5,228,570 A * 7/1993 Robinson ..... B25H 3/06 206/375
5,398,823 A * 3/1995 Anders ..... B25H 3/003 206/378
5,480,166 A * 1/1996 Milsop ..... B25B 23/00 279/143
5,511,673 A * 4/1996 Folk ..... B25H 3/003 206/378
5,544,747 A * 8/1996 Horn ..... B25H 3/04 206/350
5,645,177 A * 7/1997 Lin ..... B25H 3/04 206/378
5,740,927 A * 4/1998 Yemini ..... A47B 96/067 211/66
5,848,694 A * 12/1998 Newton ..... B25H 3/003 206/373
5,979,752 A * 11/1999 Holloway ..... G01G 23/40 116/325
6,032,393 A * 3/2000 Maxim ..... G09F 9/305 40/547
6,145,662 A * 11/2000 Newton ..... B25H 3/06 206/373
D436,304 S * 1/2001 Brown ..... D8/14
6,244,447 B1 * 6/2001 Frieze ..... A61L 2/07 206/370
6,286,678 B1 * 9/2001 Petrek ..... B01L 9/543 206/443
6,474,481 B1 * 11/2002 Liu ..... B25H 3/003 206/377
6,523,827 B1 * 2/2003 Watson ..... A63F 3/00574 273/248
6,575,313 B1 * 6/2003 Chen ..... B25H 3/02 211/70.6
6,923,407 B2 * 8/2005 Takeuchi ..... F16B 21/02 24/458
7,424,958 B1 * 9/2008 Eley ..... B25H 3/04 211/70.6
7,490,727 B2 * 2/2009 Spiers ..... A47F 7/0028 211/70.6
D594,511 S * 6/2009 Smyth ..... D21/337
7,669,723 B2 * 3/2010 Kao ..... B25H 3/04 206/349
7,717,278 B2 * 5/2010 Kao ..... B25H 3/04 206/349
7,775,358 B1 * 8/2010 Huang ..... B25H 3/021 206/349
7,806,264 B1 * 10/2010 Lai ..... B25H 3/003 206/372
8,152,003 B1 * 4/2012 Kao ..... B25H 3/04 211/70.6
8,336,709 B1 * 12/2012 Geibel ..... B25H 3/06 206/350
8,371,444 B1 * 2/2013 Huang ..... B25H 3/003 206/373
8,387,792 B2 * 3/2013 Chen ..... B25H 3/021 206/1.5
8,403,155 B1 * 3/2013 Kao ..... B25H 3/04 206/376
8,820,546 B2 * 9/2014 Moore ..... A61C 13/0022 211/13.1
8,875,884 B1 * 11/2014 Lee ..... B25H 3/04 206/1.5
8,881,917 B1 * 11/2014 Sooknanan ..... B25H 3/06 211/133.3
8,992,229 B2 * 3/2015 Spital ..... G09B 19/22 434/259
9,033,150 B2 * 5/2015 Andrich ..... B65D 25/54 206/378
9,149,730 B1 * 10/2015 Hauser ..... A63H 3/50
9,522,467 B1 * 12/2016 Kao ..... A47F 7/0028
9,625,143 B2 * 4/2017 Hsu ..... F21V 33/0084
9,694,491 B1 * 7/2017 Kao ..... B25H 3/04
2001/0001197 A1 * 5/2001 Ramsey ..... B25H 3/06 206/378
2003/0052069 A1 * 3/2003 Santa Cruz ..... A47F 7/0028 211/70.6
2003/0213760 A1 * 11/2003 Lee ..... B25H 3/003 211/70.6
2005/0133394 A1 * 6/2005 Liu ..... A45C 11/00 206/349
2005/0230335 A1 * 10/2005 Chiu ..... A47F 5/0807 211/70.6
2006/0070900 A1 * 4/2006 Brunson ..... B25H 3/003 206/373
2006/0207951 A1 * 9/2006 Wang ..... A47F 5/0006 211/70.6
2006/0219647 A1 * 10/2006 Shih ..... B25H 3/003 211/70.6
2007/0017886 A1 * 1/2007 Kao ..... A47F 5/0807 211/94.01
2007/0131631 A1 * 6/2007 Dewey ..... A47F 5/0815 211/59.1
2007/0216094 A1 * 9/2007 Sidhu ..... A63F 3/00574 273/275
2008/0149678 A1 * 6/2008 Huang ..... A45F 5/02 224/666
2009/0145865 A1 * 6/2009 Yu ..... B25H 3/003 211/70.6
2009/0146032 A1 * 6/2009 Bettenhausen ..... A61B 50/34 248/220.31
2009/0218302 A1 * 9/2009 Winnard ..... B25H 3/003 211/70.6
2010/0133213 A1 * 6/2010 Kao ..... A47F 5/0807 211/70.6
2011/0042333 A1 * 2/2011 Magnusson ..... A47F 5/0846 211/70.6
2011/0089126 A1 * 4/2011 Hsieh ..... B25H 3/003 211/70.6
2011/0174752 A1 * 7/2011 Liao ..... A47F 5/0838 211/70.6
2012/0111814 A1 * 5/2012 Kao ..... A47F 5/0846 211/70.6
2012/0138553 A1 * 6/2012 Kao ..... B25H 3/06 211/70.6
2012/0152871 A1 * 6/2012 Kao ..... A47F 5/0846 211/70.6
2013/0118938 A1 * 5/2013 Huang ..... B25H 3/00 206/372
2013/0153521 A1 * 6/2013 Kao ..... B25H 3/04 211/70.6
2013/0328467 A1 * 12/2013 Carlton ..... A47F 7/0028 312/280
2014/0305824 A1 * 10/2014 Hsieh ..... B25H 3/04 206/378
2015/0202767 A1 * 7/2015 Kao ..... B25H 3/04 211/70.6
2015/0251311 A1 * 9/2015 Huang ..... B25H 3/04 211/70.6
2015/0258678 A1 * 9/2015 Wang ..... B25H 3/06 206/378
2015/0336262 A1 * 11/2015 Kao ..... B25H 3/06 206/378

(56) References Cited

U.S. PATENT DOCUMENTS

| | | | | |
|---|---|---|---|---|
| 2016/0053987 | A1* | 2/2016 | Hsu | F21V 23/04 206/372 |
| 2016/0096264 | A1* | 4/2016 | Kao | B25H 3/003 206/378 |
| 2016/0107307 | A1* | 4/2016 | Ou | B25H 3/003 206/349 |
| 2016/0339581 | A1* | 11/2016 | Brinkhuis | B25H 3/006 |
| 2017/0232606 | A1* | 8/2017 | Kao | B25H 3/003 211/70.6 |
| 2017/0341218 | A1* | 11/2017 | Maruzzo | A47B 88/988 |
| 2017/0361454 | A1* | 12/2017 | Hsu | B25H 3/003 |

* cited by examiner

PLATFORM WITH REMOVABLE PEGS FOR ORGANIZING SOCKETS

The current application claims a priority to the U.S. Provisional Patent application Ser. No. 62/347,743 filed on Jun. 9, 2016.

FIELD OF THE INVENTION

The present invention relates generally to a socket tray. More specifically, the present invention relates to a socket tray with socket-receiving pegs whose arrangement can be reconfigured by a user.

BACKGROUND OF THE INVENTION

Socket trays are useful devices for organizing the socket heads of a socket wrench set. Traditional socket trays enable a user to retain multiple socket heads in positions that facilitate storage and retrieval. While this is arguably a necessary task, these devices often come preformed and may not work with sockets of varying shape and size. Furthermore, traditional socket trays used fixed socket-receiving pegs which preclude the user from positioning the socket heads as desired.

The present invention, the platform with removable pegs for organizing sockets, addresses this shortcoming by providing a socket tray that can be easily reconfigured. The present invention enables the user to reposition the socket-receiving pegs as desired. This enables the user to store socket heads of varying shape and size. Additionally, the present invention enables the user to organize the socket heads in a manner that facilitates storage and retrieval. In addition to organizing socket heads, the present invention functions as a holder for a ratchet device. This enables the user to store a complete socket wrench set in an easily organized manner.

DETAIL DESCRIPTIONS OF THE INVENTION

All illustrations of the drawings are for the purpose of describing selected versions of the present invention and are not intended to limit the scope of the present invention.

Figure 1:
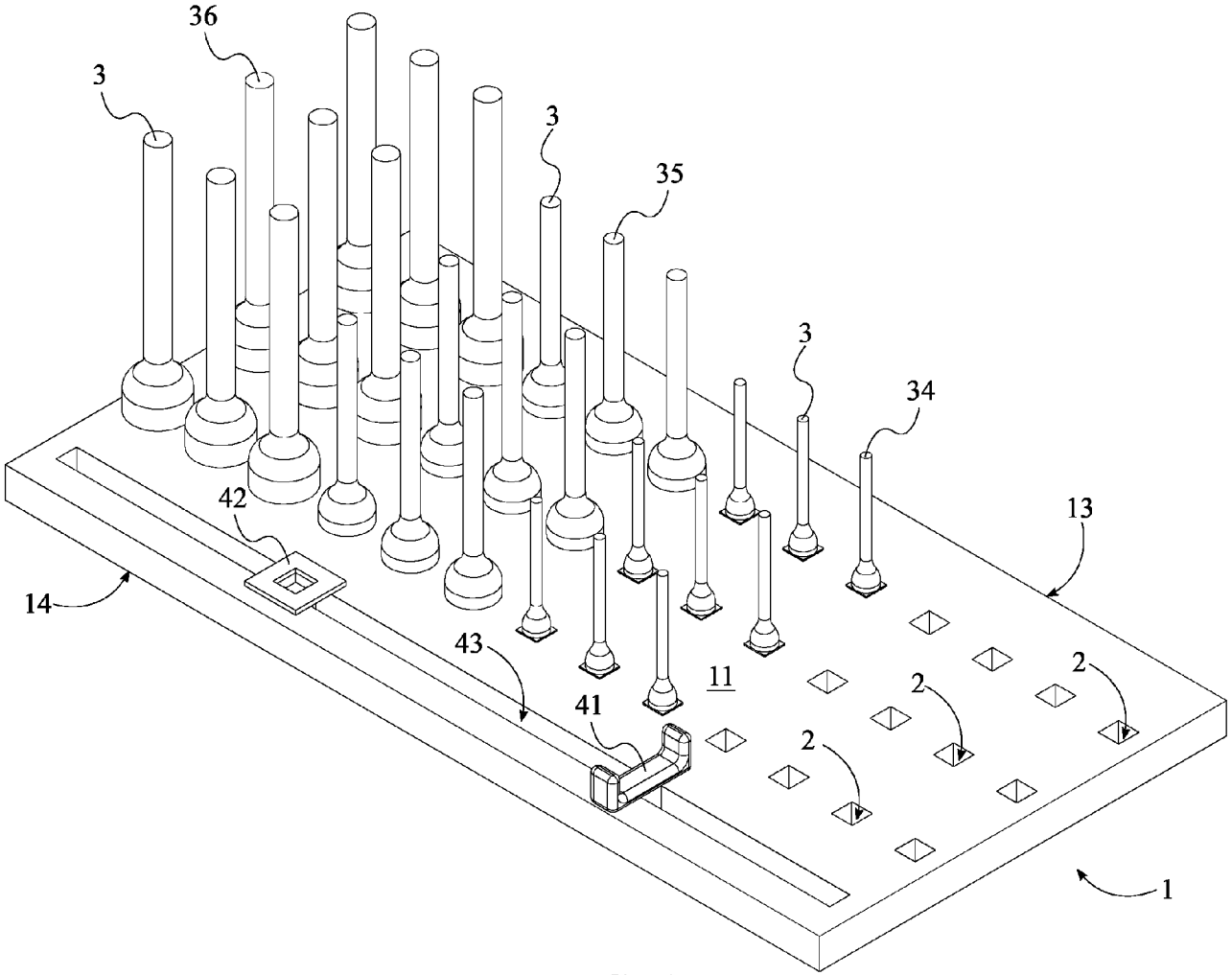
FIG. 1 is a perspective view of the present invention.
Figure 2:
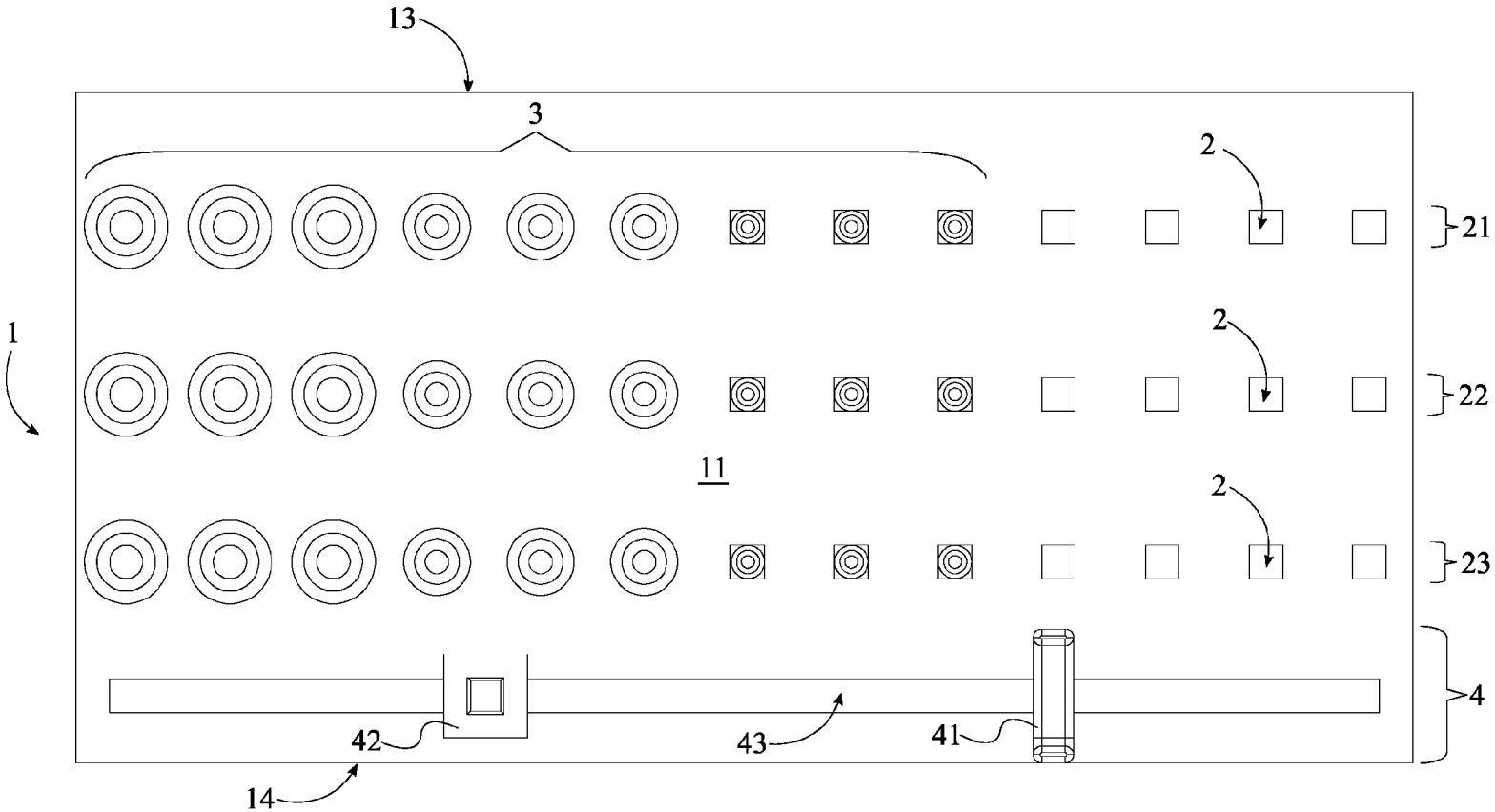
FIG. 2 is a top view of the present invention.
Figure 3:
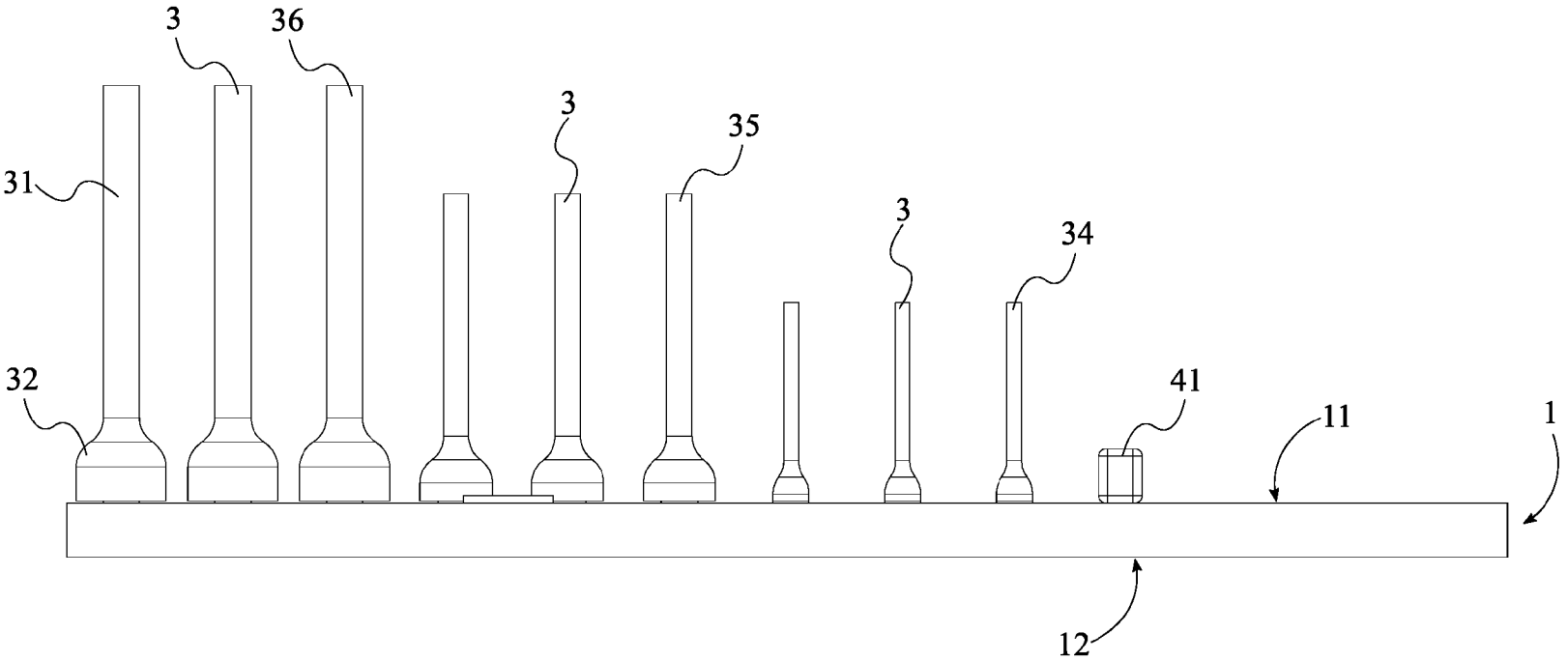
FIG. 3 is a left-side view of the present invention.

As can be seen in FIG. 1 through FIG. 6, the present invention, the platform with removable pegs for organizing sockets, is a reconfigurable socket tray that is used to store a socket wrench and a plurality of socket heads. The present invention makes use of pegs that vary in shape and size to maintain socket heads in positions that facilitate efficient storage and retrieval. Additionally, the present invention employs a platform that features multiple receptacles into which the pegs can be mounted. As such, the present invention enables a user to reconfigure the arrangement of the pegs as desired. Finally, the present invention functions as a storage device that can accommodate socket wrenches of varying size. The above described functionalities enable the present invention to function as a storage system for socket wrench sets that can be reconfigured to meet the user's needs As can be seen in FIG. 1 and FIG. 3, to achieve the above described functionalities, the present invention comprises a base panel 1, a plurality of peg receptacles 2, a plurality of socket-receiving pegs 3, and a ratchet holder 4. The base panel 1 is a rigid slab of material that functions as the structural foundation of the present invention. Specifically, the base panel 1 comprises a first face 11, a second face 12, a first lengthwise edge 13, and a second lengthwise edge 14. Each of the socket-receiving peg is a rigid rod that is used to support a socket head while not connected to a socket wrench. The first lengthwise edge 13 and the second lengthwise edge 14 are positioned opposite to each other across the base panel 1. Thus positioned, the first lengthwise edge 13 and the second lengthwise edge 14 form the boundaries of the base panel 1. Similarly, the first face 11 and the second face 12 are positioned opposite to each other about the base panel 1. Accordingly, the first face 11 and the second face 12 form the surfaces on which all other components of the present invention rest. Each of the plurality of peg receptacles 2 traverses into the base panel 1 from the first face 11. As a result, the plurality of socket-receiving pegs 3 can be inserted into and supported by the base panel 1. Additionally, the plurality of peg receptacles 2 is distributed across a first face 11 of the base panel 1 so that the user is given the option to place the socket-receiving pegs at locations that facilitate storage and retrieval of socket heads. Furthermore, each of the plurality of socket-receiving pegs 3 is engaged to a corresponding receptacle from a plurality of selected receptacles, wherein the plurality of selected receptacles is from the plurality of peg receptacles 2. Consequently, the plurality of peg receptacles 2 functions as a mounting system that can support the plurality of socket-receiving pegs 3 in positions of the user's choosing. For example, there may be twelve peg receptacles and twelve socket-receiving pegs. However, the user may only have six socket heads. Because each peg receptacle can accept a socket-receiving peg, the user is able to mount six of the twelve socket-receiving pegs in six of the peg receptacles, leaving the remaining six peg receptacles unused. The ratchet holder 4 is a mounting system used to hold the ratchet of a socket wrench. As such, the ratchet holder 4 is mounted onto the base panel 1 Additionally, the ratchet holder 4 is positioned adjacent to the plurality of peg receptacles 2 across the first face 11. Consequently, the ratchet holder 4 enables the user to store the ratchet next to the socket heads with which the ratchet is used.

Figure 4:
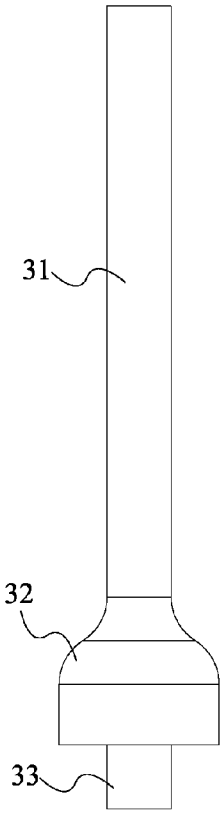
FIG. 4 is a left-side view of a single socket-receiving peg used in the present invention.

As can be seen in FIG. 1 and FIG. 4, the configuration of each of the plurality of socket-receiving pegs 3 enables the user to mount a socket head in a position that facilitates storage and retrieval. To accomplish this, each of the plurality of socket-receiving pegs 3 comprises a socket-mounting shaft 31, a base 32, and a male insert 33. The socket-mounting shaft 31 is a rigid rod that the user inserts into a desired socket head. The base 32 is a rigid body that is grasped by the user when engaging each of the socket-receiving pegs into the corresponding receptacle. Additionally, the base 32 is terminally connected to the socket-mounting shaft 31 so that the user may reposition the socket-mounting shaft 31 without dislodging the desired socket head. The male insert 33 is an interlocking member that enables the user to mount each of the socket-receiving pegs 3 onto the base panel 1. To accomplish this, the male insert 33 is adjacently connected to the base 32, opposite to the socket-mounting shaft 31. Additionally, the male insert 33 is colinearly aligned to the socket-mounting shaft 31. Finally, the male insert 33 engages into the corresponding receptacle. As a result, the user is able to mount each of the socket-receiving pegs 3 onto the base panel 1 by depositing the male insert 33 into the corresponding receptacle. Thus positioned, each of the socket-receiving pegs 3 maintains the desired socket in an orientation that facilitates storage and retrieval.

As can be seen in FIG. 1 and FIG. 2, the present invention is designed to grant the user a large degree of freedom on where to place the plurality of socket-receiving pegs 3. To accomplish this, the plurality of peg receptacles 2 is placed into a grid pattern. Consequently, the user is able to position the plurality of socket-receiving pegs 3 in neat rows or in positions that facilitate achieving a desired aesthetic design. As described above, the present invention is designed to accommodate socket heads of varying shape and size. As such, the plurality of socket-receiving pegs 3 comprises at least one shallow-length peg 34, at least one medium-length peg 35, and at least one deep-length peg 36. To increase placement options the plurality of socket-receiving pegs 3, the plurality of peg receptacles 2, which are arranged into a grid pattern, comprises a first row 21, a second row 22, and a third row 23. The first row 21 is positioned adjacent to the second row 22. Similarly, the third row 23 is positioned adjacent to the second row 22, opposite to the first row 21. Thus positioned, the first row 21, the second row 22, and the third row 23 create a grid that enables the user to serially mount the plurality of socket-receiving pegs 3 onto the base panel 1. Making use of this functionality, the at least one shallow-length peg 34 is positioned into the corresponding receptacle within the first row 21. Similarly, the at least one medium-length peg 35 is positioned into the corresponding receptacle within the second row 22. Likewise, the at least one deep-length peg 26 is positioned into the corresponding receptacle within the third row 23. Consequently, the user is able to organize the socket heads into groups that vary based on socket head size. Additionally, the user is able to position the at least one shallow-length peg 34, the at least one medium-length peg 35, and the at least one deep-length peg 36 into any of the plurality of peg receptacles 2 to organize the socket heads as desired.

As can be seen in FIG. 1 and FIG. 2, the ratchet holder 4 of is designed to accommodate ratchets of varying shape and size. As such, the ratchet holder 4 comprises a slide channel 43, a handle mount 41, and a drive shaft mount 42. The slide channel 43 traverses into the base panel 1 from the first face 11. Consequently, the slide channel 43 functions as a raceway along which the user is able to adjust the position of the handle mount 41 and the drive shaft mount 42. Furthermore, the slide channel 43 is oriented parallel to the first lengthwise edge 13. Moreover, the slide channel 43 is positioned offset from the plurality of peg receptacles 2. Thus positioned, the slide channel 43 enables the user to mount the ratchet onto the ratchet holder 4 in a location that does not impede storing sockets on the plurality of socket-receiving pegs 3. The handle mount 41 is a preferably a U-shaped bracket that holds the handle of an inserted ratchet in place while the ratchet is being stored on the present invention. Similarly, the drive shaft mount 42 is a platform with a receptacle that holds the drive shaft of the inserted ratchet. The handle mount 41 and the drive shaft mount 42 are slidably engaged along the slide channel 43 so that the user can adjust the ratchet holder 4 to support ratchets of varying length.

Figure 5:
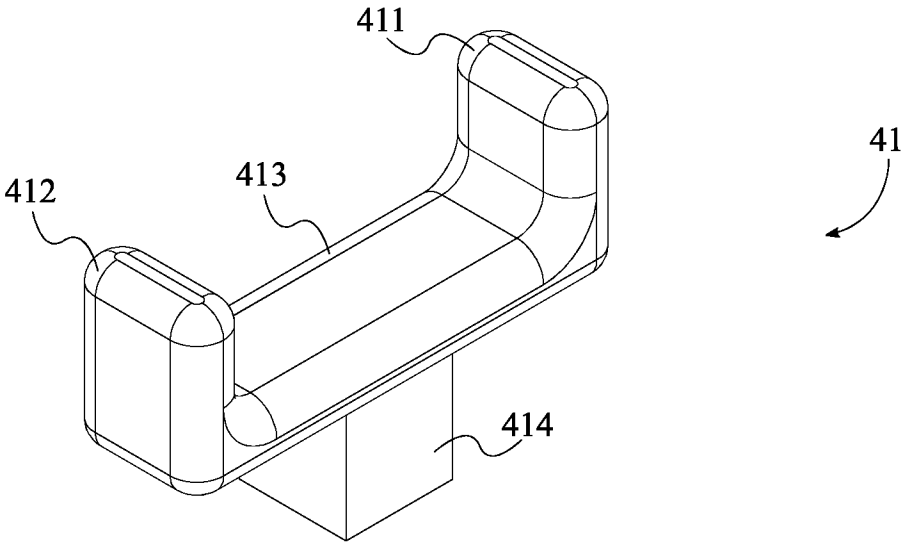
FIG. 5 is a perspective view of the handle mount used in the present invention.

As can be seen in FIG. 1 and FIG. 5, to expound upon the descriptions of the handle mount 41, it is necessary to disclose that the handle mount 41 comprises a first bracketing beam 411, a second bracketing beam 412, a support beam 413, and a first channel-engaging insert 414. The first bracketing beam 411, the second bracketing beam 412, and the support beam 413 are rigid rods that form the U-shaped bracket for the handle of the ratchet. As such, the first bracketing beam 411 is terminally connected to the support beam 413. Conversely, the second bracketing beam 412 is terminally connected to the support beam 413, opposite to the first bracketing beam 411. Thus connected, the first bracketing beam 411 and the second bracketing beam 412 form the two arms of the U-shaped handle mount 41. The first channel-engaging insert 414 is an interlocking fastener that is used to connect the handle mount 41 to the slide channel 43. To accomplish this, the first channel-engaging insert 414 is laterally connected to the support beam 413. Additionally, the first bracketing beam 411 and the second bracketing beam 412 are positioned parallel to the first channel-engaging insert 414. Furthermore, the first bracketing beam 411, the second bracketing beam 412, and the first channel-engaging insert 414 are oriented perpendicular to the support beam 413. Thus positioned, the first channel-engaging insert 414, the first bracketing beam 411, and the second bracketing beam 412 form a support structure that is used to retain the handle of the ratchet in a position that facilitates storage and retrieval. The first channel-engaging insert 414 is slidably engaged along the slide channel 43. As a result, the user is able to slide the handle mount 41 along the slide channel 43 to accommodate ratchets of varying length.

Figure 6:
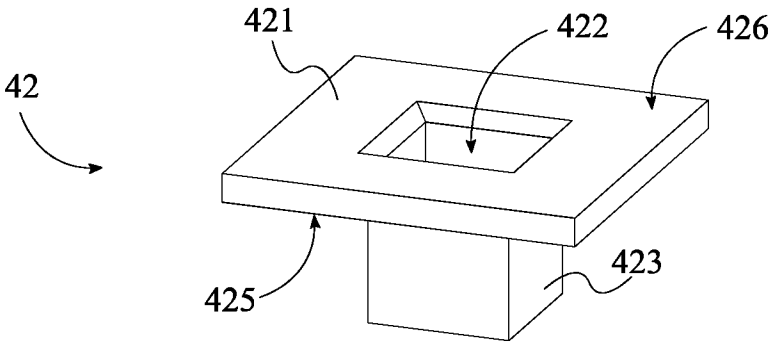
FIG. 6 is a perspective view of the drive shaft mount used in the present invention.

As can be seen in FIG. 1 and FIG. 6, to expound upon the descriptions of the drive shaft mount 42, it is necessary to disclose that the drive shaft mount 42 comprises a support platform 421, a drive shaft receptacle 422, and second channel-engaging insert 414. The support platform 421 is a rigid slab that is used to support the head of the ratchet. The second channel-engaging insert 423 functions similarly to the first channel-engaging insert 414. In that, the second channel-engaging insert 423 is an interlocking fastener that is used to connect the drive shaft mount 42 to the slide channel 43. The drive shaft receptacle 422 traverses into a first side 424 of the support platform 421. Consequently, the drive shaft receptacle 422 length.

Although the invention has been explained in relation to its preferred embodiment, it is to be understood that many other possible modifications and variations can be made without departing from the spirit and scope of the invention as hereinafter claimed.

What is claimed is:

1. A platform with removable pegs for organizing sockets comprises:

a base panel;

a plurality of peg receptacles formed in the base panel;

a plurality of socket-receiving pegs;

a ratchet holder for storing a ratchet;

the base panel comprises a first face, a second face, a first lengthwise edge, and a second lengthwise edge;

each of the plurality of socket-receiving pegs comprises a socket mounting shaft, a base, and a male insert, the socket mounting shaft extending upwardly from the base;

the male insert extending downwardly from the base opposite the socket mounting shaft, the male insert being colinearly aligned to the socket mounting shaft;

the ratchet holder comprises a slide channel slot, a U-shaped handle mount for gripping a handle of the ratchet, and a generally square-shaped drive shaft mount for holding a drive shaft of the ratchet, wherein the drive shaft mount is separate and spaced apart from the handle mount;

the first lengthwise edge and the second lengthwise edge being positioned opposite to each other across the base panel;

the first face and the second face being positioned opposite to each other about the base panel;

each of the plurality of peg receptacles traversing into the base panel from the first face;

the plurality of peg receptacles being distributed across the first face of the base panel;

each of the plurality of socket-receiving pegs being engaged to a corresponding receptacle from the plurality of peg receptacles;

the ratchet holder being positioned adjacent to the plurality of peg receptacles across the first face;

each male insert being placed into the corresponding receptacles; the slide channel traversing into the base panel from the first face; the slide channel being oriented parallel to the first lengthwise edge and extending across substantially the entire length of the base panel; the slide channel being spaced apart from the plurality of peg receptacles; and the handle mount and the drive shaft mount being slidably engaged along the slide channel in order to adjust the position of the ratchet.

2. The platform with removable pegs for organizing sockets as claimed in claim 1 comprises:

the plurality of peg receptacle being arranged into a grid pattern.

3. The platform with removable pegs for organizing sockets as claimed in claim 2 comprises:

the plurality of socket-receiving pegs comprises at least one shallow-length peg, at least one medium-length peg, and at least one deep-length peg;

the grid pattern comprises a first row, a second row, and a third row;

the first row being positioned adjacent to the second row;

the third row being positioned adjacent to the second row, opposite to the first row;

the at least one shallow-length peg being positioned into the corresponding receptacle within the first row;

the at least one medium-length peg being positioned into the corresponding receptacle within the second row; and the at least one depth-length peg being positioned into the corresponding receptacle within the third row.

4. The platform with removable pegs for organizing sockets as claimed in claim 1 comprises:

the handle mount comprises a first bracketing beam, a second bracketing beam, a support beam, and a first channel-engaging insert;

the first bracketing beam being terminally connected to the support beam; the second bracketing beam being terminally connected to the support beam, opposite to the first bracketing beam;

the first channel-engaging insert being laterally connected to the support beam;

the first bracketing beam, the second bracketing beam, and the first channel-engaging insert being oriented perpendicular to the support beam; and the first channel-engaging insert being slidably engaged along the slide channel.

5. The platform with removable pegs for organizing sockets as claimed in claim 1 comprises: the drive shaft mount comprises a support platform, a drive shaft receptacle, and a second channel-engaging insert;

the drive shaft receptacle traversing into a first side of the support platform;

the second channel-engaging insert being connected to a second side of the support platform;

the first side being positioned opposite to the second side about the support platform; and the second channel-engaging insert being slidably engaged along the slide channel.

* * * * *